US005681416A

United States Patent [19]

Neumann et al.

[11] Patent Number: 5,681,416

[45] Date of Patent: *Oct. 28, 1997

[54] FLOOR PROTECTORS

[76] Inventors: Tom Neumann, 27 Nottingham Boulevard, Sherwood Park, Alberta, Canada, T8A 5M4; Bruce Buckwold; Richard Buckwold, both of 75-24th Street East, Saskatoon, Saskatchewan, Canada, S7K 0K3

[ * ] Notice: The term of this patent shall not extend beyond the expiration date of Pat. No. 5,535,480.

[21] Appl. No.: 590,508

[22] Filed: Jan. 24, 1996

Related U.S. Application Data

[63] Continuation-in-part of Ser. No. 395,658, Feb. 28, 1995, Pat. No. 5,535,480, which is a continuation of Ser. No. 144,245, Nov. 1, 1993, abandoned.

[30] Foreign Application Priority Data

Oct. 6, 1993 [CA] Canada ..... 2107814

[51] Int. Cl.[6] ..... A47B 91/06

[52] U.S. Cl. ..... 156/304.5; 428/58; 428/119; 16/42 R

[58] Field of Search ..... 428/58, 119, 343; 156/304.5; 16/42 R; 404/35, 41; 108/56.1, 56.3, 143; 52/177; 248/346.3, 346.5, 346.2, 346.02

[56] References Cited

U.S. PATENT DOCUMENTS

| | | | |
|---|---|---|---|
| 4,156,048 | 5/1979 | Davis | 428/354 |
| 5,057,356 | 10/1991 | Smith | 428/192 |
| 5,535,480 | 7/1996 | Neumann et al. | 16/42 R |

*Primary Examiner*—Alexander Thomas

*Attorney, Agent, or Firm*—Murray E. Thrift; Adrian D. Battison

[57] ABSTRACT

A floor protector protects floors against damage from heavy objects supported on or sliding across the floor and reduces the effort required to move the objects. The protector includes an elongate web with raised lips along its opposite edges and interlocking formations on its opposite ends. The interlocking formations allow the connection of plural strips end-to-end.

3 Claims, 3 Drawing Sheets

FLOOR PROTECTORS

CROSS REFERENCE TO RELATED APPLICATION

This application is a continuation-in-part of application Ser. No. 08/395,658, filed Feb. 28, 1995, now U.S. Pat. No. 5,535,480 which is a continuation of application Ser. No. 08/144,245, filed Nov. 1, 1993, now abandoned.

FIELD OF THE INVENTION

The present invention relates to floor protectors and more particularly to a device useful in supporting or moving heavy objects on a floor. The protectors serve to protect floors against damage caused by heavy objects, and also to ease the effort required to move such objects.

BACKGROUND

Heavy objects, for example appliances and heavy furniture, are liable to damage floors on which they are supported, especially in movement of the objects across the floors. All types of floors, including vinyl, hardwood and ceramic are subject to such damage, with modern vinyl of the type commonly used in kitchen flooring being particularly susceptible. The physical effort required to move such items is another significant problem, particularly where the object does not slide readily on the floor or floor covering in question.

In U.S. Pat. No. 5,057,356, issued 15 Oct. 1991 to Terry C. Smith it is proposed to reduce damage to flooring caused by a heavy appliance by supporting the appliance on two secondary floor surfaces resting on the floor to be protected and supporting the appliance. To provide for movement of the appliance away from its normal position two additional temporary support surfaces are provided which butt against ends of the secondary floor surfaces so that the appliance can be moved between the secondary floor surfaces and the temporary support surfaces without being placed directly on the floor. The temporary support surfaces are equipped with removable ramps to facilitate initial raising of the appliance onto the temporary support surfaces. After their initial use, the ramps are severed from the temporary support surfaces. This prior art system butts the stationary secondary floor surfaces against a wall to ensure that they do not move as a heavy appliance slides onto the supports. It also requires that the temporary support surfaces be butted against the stationary secondary floor surfaces to ensure that they do not move. This prior art system does not provide for the protection of a floor during the transportation of an appliance or other heavy object across a floor, for example across a room during installation or removal.

The present invention is concerned with a floor protector that allows the movement of heavy objects across any floor, while protecting the floor against scratching, gouging or other damage.

SUMMARY

According to the present invention there is provided a floor protector for use in moving a heavy object across a floor surface, said protector comprising an elongate strip of a plastic material that is resistant to compressive deformation under the weight of said object, the strip having opposite first and second ends, a base surface for supporting the strip on the floor surface, a smooth, uninterrupted upper surface parallel to the base surface and extending from the first end to the second end, the first and second ends of each strip being shaped to form respective first and second interlocking formations, the first and second interlocking formations being configured to interlock with the second and first interlocking formations respectively of other, similar protectors to hold the protectors together end to end against separation in directions along and across the strip and permitting separation of the strips in a direction normal to the strip.

The interlocking formations allow strips to be connected end-to-end to provide a protective track along which the object may slide. The effort required to move an object along the track is generally much less than that required to move the same object over the bare floor because of reduced friction on the smooth surface of the track, The track may be duplicated where desired, for example to support the feet of an appliance. Because of the interlock, the track does not need to be butted against a wall to prevent separation of the strips where they join, The strips are preferably equipped with lips along their side edges to ensure that the feet of heavy appliances or furniture do not slide off the strips onto the floor being protected, It is also preferred that the material from which the strips are made is inert with respect to vinyl floors. Discolouration of vinyl flooring is a problem when some plastic materials are placed in contact with the vinyl.

The strips are useful on any floor surface, and on some floor coverings as well, for example industrial and other carpeting that is not so highly cushioned that the interlocking ends of the strips will come apart, Strips according to the present invention can be used, where desired, as long term support.

The invention also provides a floor protection kit consisting of a plurality of the strips that may be connected end-to-end.

According to a further aspect of the present invention, there is provided a method of moving a heavy object across a floor surface from a first position to a second position spaced a distance from the first position, said method comprising:

providing a plurality of protectors, each comprising an elongate strip of hard plastic material, each strip having:

opposite first and second ends a length between the first and second ends less than the distance between the first and second positions, a base surface for supporting the strip on the floor surface, a smooth, uninterrupted upper surface parallel to the base surface and extending from the first end to the second end, and first and second interlocking formations on the respective first and second ends of the strip, the first and second interlocking formations being configured to interlock with the second and first interlocking formations respectively of each other strip to hold the strips together end to end;

placing a plurality of the protectors on the floor surface;

arranging the protectors end to end in two tracks with adjacent protectors in each track having adjacent first and second ends respectively;

interlocking the first and second interlocking formations on the adjacent first and second ends of the protectors in each track;

arranging the tracks substantially parallel to one another and extending from the first position to the second position;

supporting the object on the tracks at the first position;

sliding the object along the tracks to the second position;

removing the object from the tracks;

disconnecting the protectors from one another; and removing the protectors from the floor surface, It may be of advantage to stick the first strips to the floor using a double-faced adhesive tape, This holds the tracks against slipping as the object, for example a heavy appliance, slides along them, The tape is easily released from the flooring by lifting the strip.

BRIEF DESCRIPTION OF THE DRAWINGS

In the accompanying drawings, which illustrate exemplary embodiments of the present invention.

DETAILED DESCRIPTION

Figure 1:
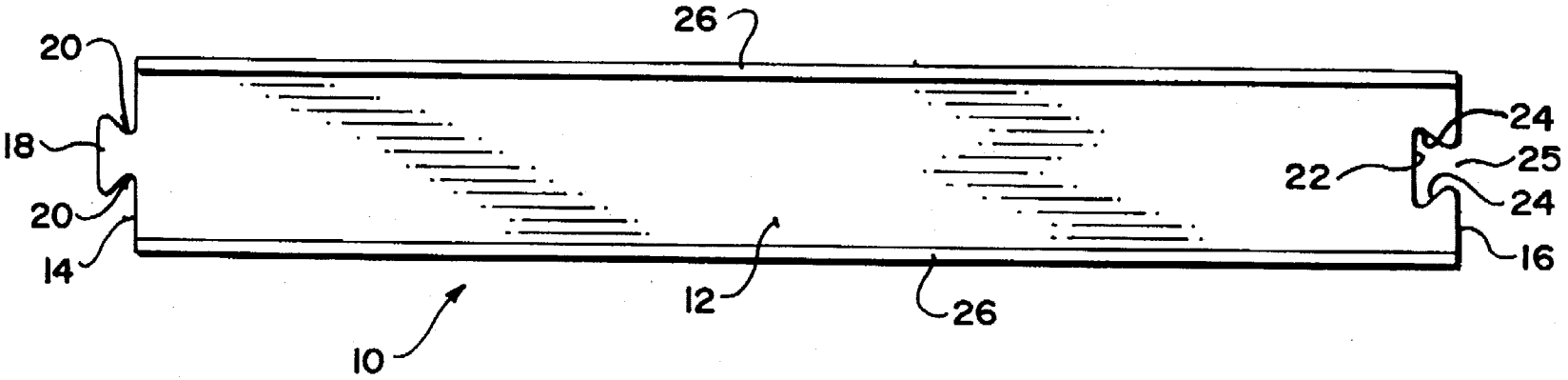
FIG. 1 is a plan view of a strip according to the present invention.

Referring to the accompanying drawings, there is illustrated a protector strip 10 for protecting floors from damage caused by heavy objects being transported across the floor. The strip is fabricated from a hard plastic material that is inert with respect to vinyl and other flooring materials. The strip material is also resistant to compressive deformation under the weight of the object to be transported. This ensures that the strip will not dimple under the weight applied to it, which would make sliding of an object along the strip difficult. It also means that the strip has sufficient rigidity to distribute concentrated loadings on its top surface over a larger area of its bottom surface. The strip may however, have some flexibility.

The protector strip 10 includes a broad web 12 that, in use, rests on the floor. The web has parallel sides and two longitudinally spaced ends 14 and 16. At the end 14, the web is formed into a tongue 18 with undercuts 20 on its opposite longitudinal sides. At the end 16, the web is formed with a reentrant notch 22 with undercuts 24 and a narrow neck 25. The tongue and the notch match in configuration so that the tongue will fit into a notch of another, similarly constructed protector strip to prevent the longitudinal and lateral separation of the strips, while allowing their separation in a direction normal to the strips.

The strip is provided with two spaced apart lips 26 that extend the length of the strip, along its opposite edges. These inhibit the inadvertent sliding of an object off the protector strip.

Figure 3:
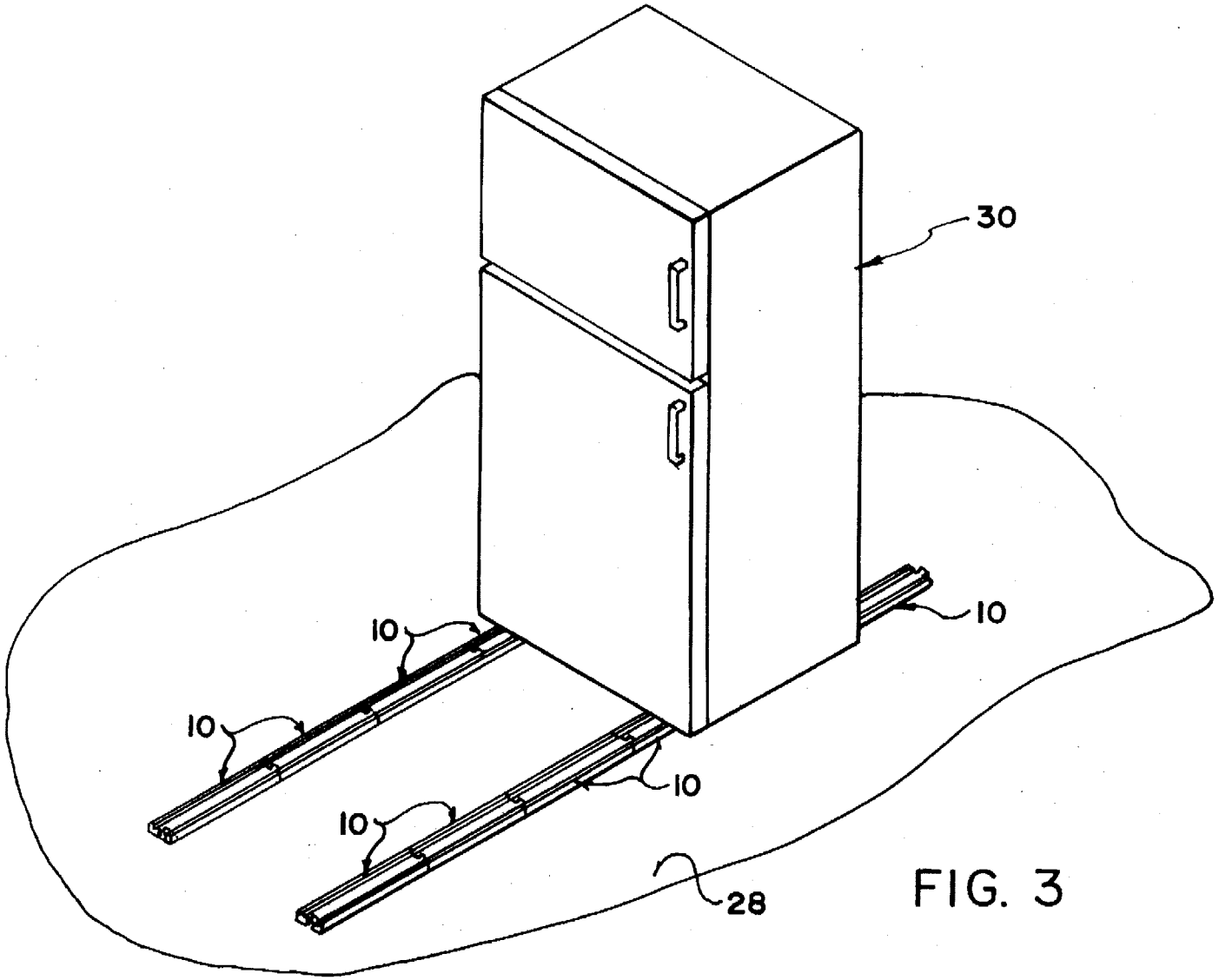
FIG. 3 is an isometric view showing plural strips joined into two parallel tracks for supporting an appliance.

As illustrated in FIG. 3, a series of these strips may be connected end-to-end across a floor 28 to provide two parallel tracks on which an appliance 30 may slide in order to protect the floor on which the strips rest. The first strip 10a in each track is fastened temporarily to the floor by double faced adhesive tape 31 adhered to the bottom of the strip and to the floor. After use, the adhesive tape is released from the floor by lifting the strip at one end and peeling the strip and adhesive from the floor. This prevents the slippery strip material from sliding on the floor. It is to be understood that adhesive means other than double faced tape may be used. Many adhesives that can adhere to and be readily released from the floor surface without damaging the floor are suitable.

Figure 2:
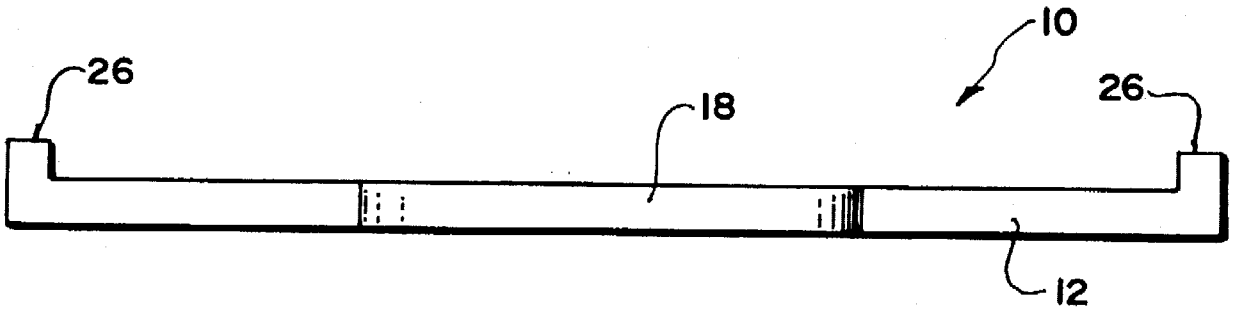
FIG. 2 is an end elevation of a strip according to the present invention.
Figure 4:
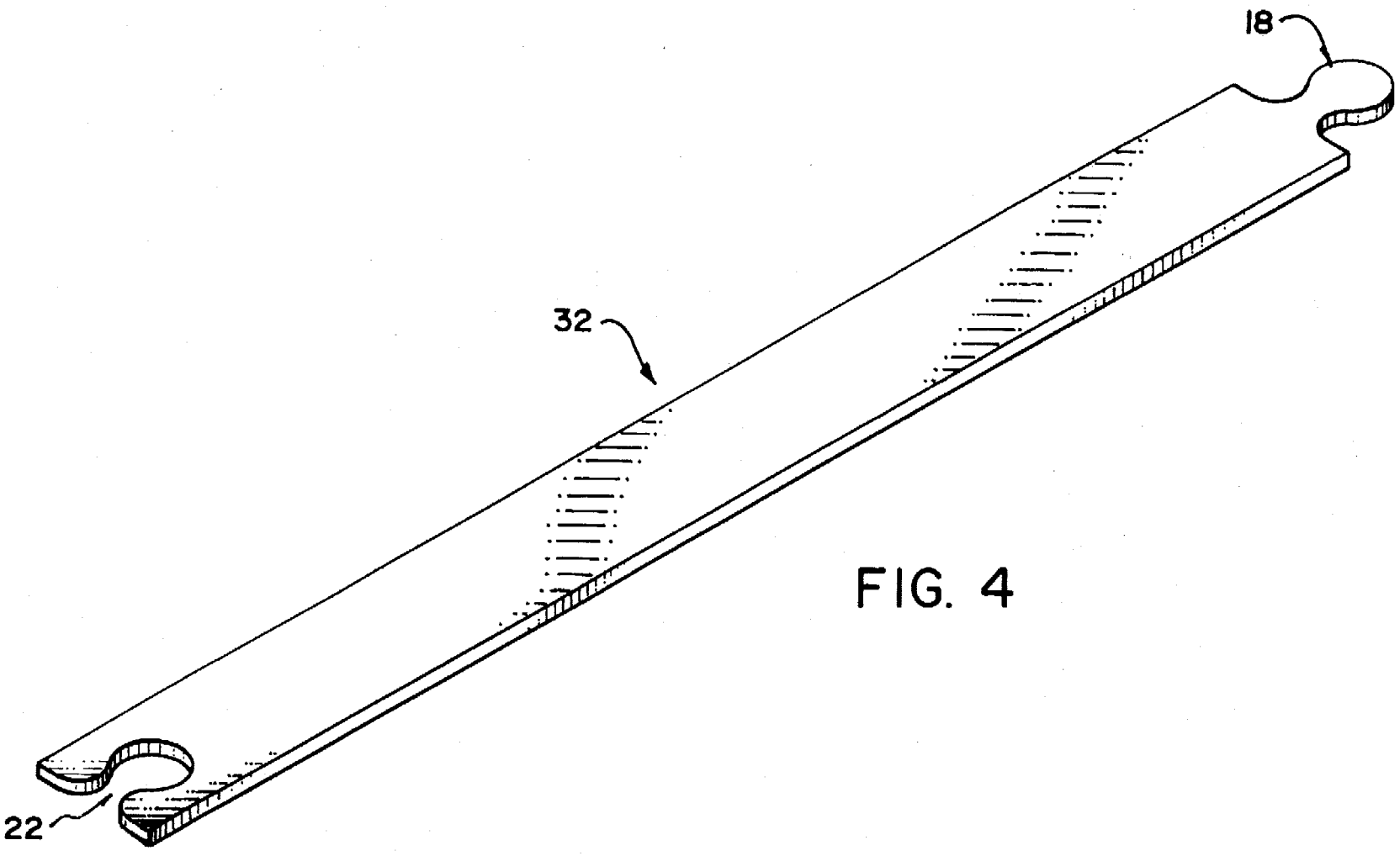
FIG. 4 illustrates an alternative embodiment of the strips.

An alternative embodiment of the strip is illustrated in FIG. 4. In that embodiment, the strip 32 does not have the edge lips 26. It is otherwise the same as the embodiment of FIGS. 1 to 3.

While particular embodiments of the present invention have been described in the foregoing, it is to be understood that other embodiments are possible within the scope of the invention, which is to be ascertained solely by the scope of the appended claims.

We claim:

1. A method of providing a temporary base to protect a floor and to reduce resistance when moving a heavy object across the floor surface from a first position to a second position spaced a distance from the first position, said method comprising:

providing a plurality of protectors, including two first protectors and two second protectors, each protector comprising a single, elongate, integral strip of hard plastic material;

providing each strip with opposite first and second end, a length between the first and second ends less than the distance between the first and second positions, a base surface for supporting the strip on the floor surface, and a smooth, uninterrupted upper surface parallel to the base surface and extending from the first end to the second end;

providing each strip with first and second interlocking formations on the respective first and second ends of the strip, the first and second interlocking formations being configured to interlock with the second and first interlocking formations respectively of each other strip to hold the strips together end to end;

placing the protectors on the floor surface;

arranging the protectors end to end in two substantially parallel tracks with the first protectors in the respective tracks at the first position and the second protectors in the respective tracks at the second position, and with adjacent protectors in each track having adjacent first and second ends respectively;

interlocking the first and second interlocking formations on the first and second ends of the protectors in each track;

supporting the object exclusively on the two integral strips of the first protectors at the first position; and sliding the object along the tracks to the second position; and supporting the object exclusively on the two integral strips of the second protectors at the second position.

2. A method according to claim 1 further comprising adhering to the floor the protector at the first position in each track.

3. A method according to claim 2 wherein the protectors at the first positions are adhered to the floor with double faced adhesive tape.

* * * * *